United States Patent [19]

Furbacher

[11] 3,957,022

[45] May 18, 1976

[54] CARBURETOR DECELERATION EMISSION CONTROL

[75] Inventor: John H. Furbacher, Dearborn, Mich.

[73] Assignee: Ford Motor Company, Dearborn, Mich.

[22] Filed: Sept. 2, 1975

[21] Appl. No.: 609,765

[52] U.S. Cl. ..... 123/97 B; 123/127; 261/23 A; 261/DIG. 19; 261/DIG. 74

[51] Int. Cl.[2] ..... F02M 11/02

[58] Field of Search ..... 123/97 B, 127, 103 E; 261/23 A, DIG. 19, DIG. 74

[56] References Cited

UNITED STATES PATENTS

| | | | |
|---|---|---|---|
| 2,609,806 | 9/1952 | Winkler | 123/127 |
| 2,871,001 | 1/1959 | Stoltman | 261/23 A |
| 2,957,463 | 10/1960 | Schnabel | 261/DIG. 19 |
| 3,085,790 | 4/1963 | Sterner | 261/23 A |
| 3,547,089 | 12/1970 | Pierlot | 261/DIG. 19 |
| 3,596,642 | 8/1971 | Nakata | 123/97 B |
| 3,741,177 | 6/1973 | Schultz | 123/97 B |
| 3,753,427 | 8/1973 | Cedar | 123/97 B |
| 3,852,379 | 12/1974 | Shishido et al. | 261/DIG. 19 |

*Primary Examiner*—Tim R. Miles
*Attorney, Agent, or Firm*—Robert E. McCollum; Keith L. Zerschling

[57] ABSTRACT

A four barrel carburetor is provided with apparatus that operates automatically during predetermined engine deceleration operating conditions to crack open the secondary induction passage throttle valve to supply a quantity of fuel and air to the engine that is supplemental to that being supplied through the primary induction system, to decrease the output of harmful emissions by causing a cleaner burn.

9 Claims, 3 Drawing Figures

CARBURETOR DECELERATION EMISSION CONTROL

Figure 1:
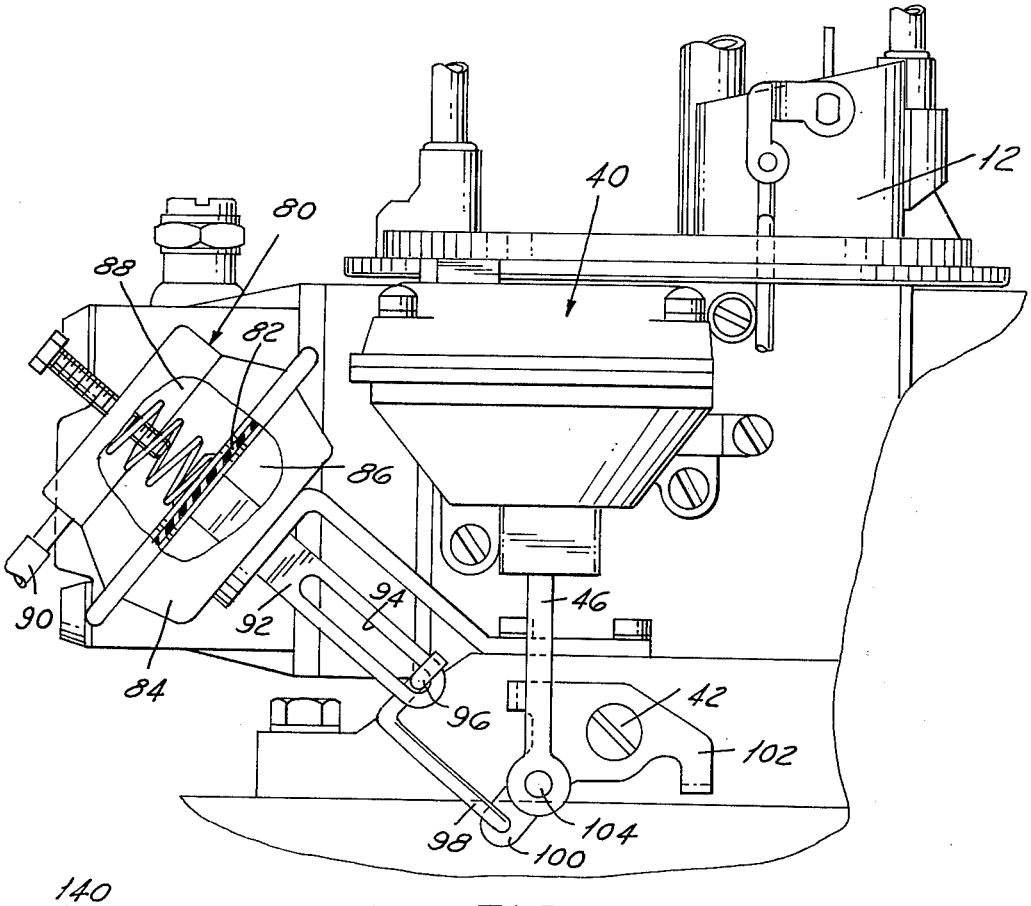

This invention relates in general to a two-stage motor vehicle-type carburetor. More particularly, it relates to one that is provided with suitable apparatus for cracking open the secondary induction passage throttle valve during engine deceleration conditions to improve emission output.

This invention has particular use with four barrel truck-type carburetors, although it will be clear that it will apply equally as well to any carburetor having dual stage operation. In a four barrel carburetor of the type described hereinbefore, the conventional idle system provides a quite lean mixture to the engine cylinders. During closed throttle deceleration operation, therefore, the engine will be provided with a very lean mixture to the point where incomplete burning may occur, which may result in unburned exhaust gases and the emission of undesirable elements into the atmosphere. If, during this time, fuel and air is added to supplement the idle system mixture, then a more complete burning of the mixture may occur. The addition of fuel alone generally is not sufficient but both fuel and air should be added to provide the proper mixture ratio.

Accordingly, it is a primary object of this invention to provide an engine deceleration control apparatus incorporated in the carburetor that operates during deceleration conditions when the primary and secondary carburetor throttle valves are essentially closed to crack open the secondary induction passage throttle valve to supply a quantity of both fuel and air mixture to the engine to supplement that mixture emanating from the primary induction passage.

It is another object of the invention to provide a four barrel carburetor construction with a vacuum servo connected to the secondary induction passage throttle valve and operable during predetermined deceleration conditions to crack open the secondary throttle valve to allow the induction of an additional air/fuel mixture into the engine.

It is a still further object of the invention to provide a four barrel carburetor construction having a servo operated secondary throttle valve system with an additional vacuum servo that is independently operable during predetermined engine deceleration operating conditions to crack open the secondary throttle valve to allow the addition of air and fuel to the engine regardless of the position of the primary throttle valve and quantity of flow of mixture through the primary induction passage.

It is another object of the invention to provide a four barrel carburetor construction having primary and secondary induction passages each provided with a separate throttle valve rotatably mounted across the respective passages to control the flow of an air/fuel mixture therethrough to the engine cylinders, the secondary throttle valve being opened to provide greater air flow capacity to the engine during engine acceleration conditions by means of a vacuum servo connected to the throttle valve and operated in response to a vacuum signal in the primary induction passage venturi at the appropriate time, an additional vacuum servo being connected to the secondary throttle valve by a lost motion connection and operable in response to the attainment of both a predetermined engine speed and vacuum level condition to crack open the secondary throttle valve to permit the induction of an air/fuel mixture through the secondary passage to supplement that flow quantity being supplied to the engine by the primary carburetor section, to render the engine air/fuel mixture burning more complete and thereby reduce the output of harmful emissions.

It is a still further object of the invention to provide a carburetor of the construction as described immediately above in which the second servo is actuated by intake manifold vacuum as controlled by a solonoid actuated valve that is electrically actuated in response to engine speed and manifold vacuum both rising above a predetermined level.

Figure 3:
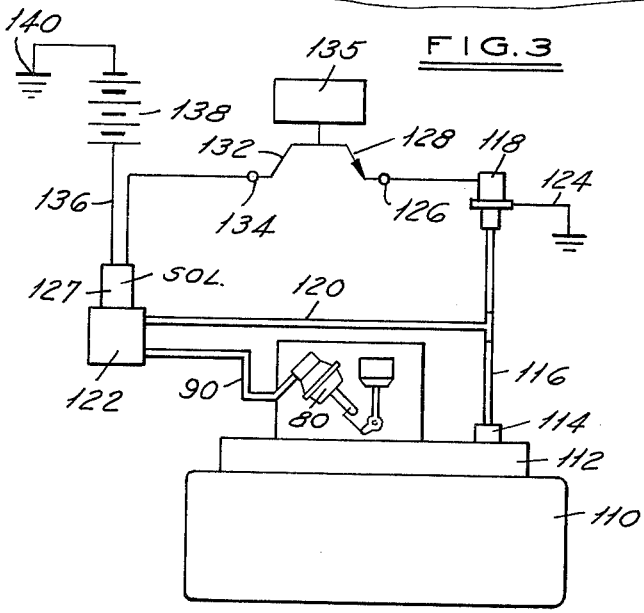
Figure 2:
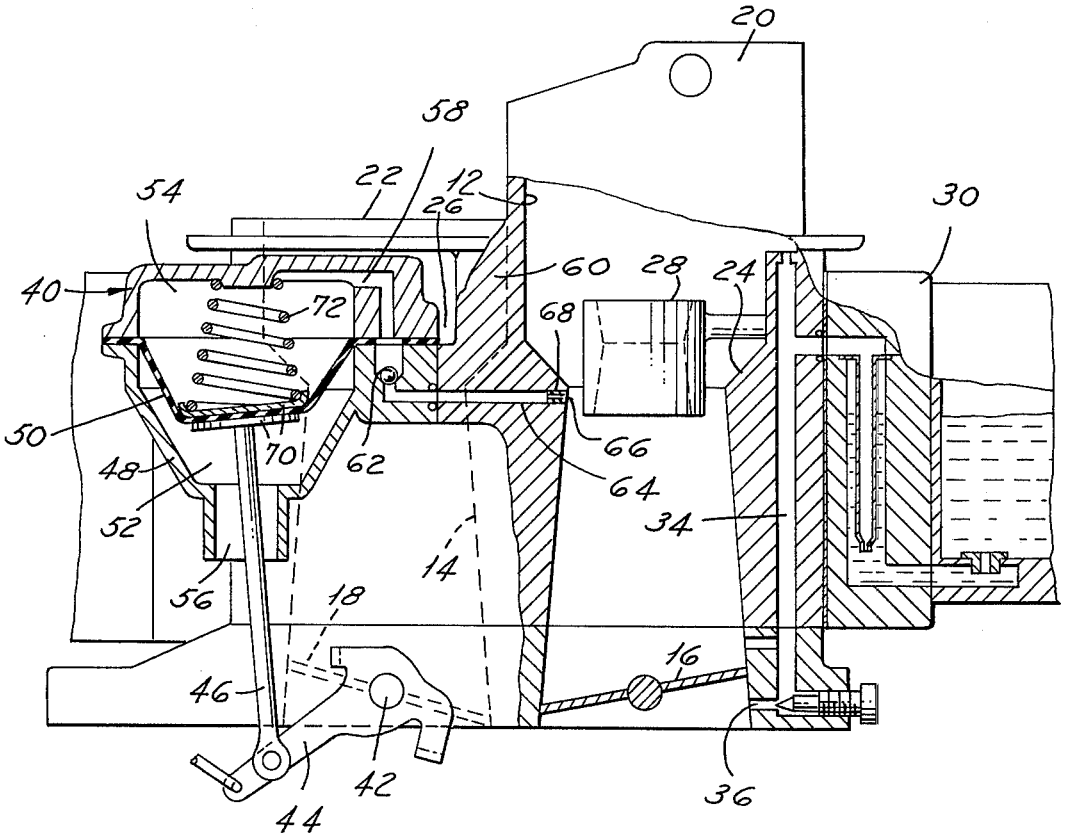

Other objects, features, and advantages of the invention will become more apparent upon reference to the succeeding detailed description thereof, and to the drawings illustrating a preferred embodiment thereof, wherein, FIG. 1 is a side elevational view of a portion of a carburetor embodying the invention, with parts broken away and in section;

FIG. 2 is a schematic cross sectional view of that portion of the carburetor illustrated in FIG. 1; and FIG. 3 schematically illustrates a control system forming a part of the invention.

FIG. 1, which is essentially to scale, shows a major portion of a fuel barrel, two-stage carburetor of the downdraft type. For clarity, only a single primary and a single secondary barrel will be shown and described since the remaining are merely duplicates. FIG. 2 is essentially a cross sectional view of a portion of the carburetor shown in FIG. 1; however, the parts therein are more schematically illustrated for ease in description and understanding of the invention.

Referring to FIGS. 1 and 2, therefore, the carburetor is shown as having a primary induction passage or bore 12, a secondary induction passage or bore 14, each with its own throttle valves 16 and 18, respectively. The latter are individually rotatably mounted in the side walls of the carburetor for rotation between a minimum essentialy closed position blocking flow through the passage to an essentially vertical wide-open throttle position allowing maximum air/fuel mixture flow.

Each of the induction passages is open at its upper end 20, 22 to clean air emanating from the conventional air cleaner, not shown, at essentially atmospheric pressure. The lower ends of the induction passages are both adapted to be connected to the intake manifold, not shown, of an internal combustion engine for passage of the air/fuel mixtures to the engine cylinders in the conventional manner.

Both the primary and secondary induction passages are formed with a fixed area venturi 24, 26 in each of which is fixed a boost venturi 28. For clarity, a boost venturi is shown only in the primary induction passage as well as the other fuel system elements to be described. The boost venturi is connected to fuel in a conventional fuel bowl 30 by means of suitable passages that include an idle system air/fuel passage 34 and a conventional idle discharge passage 36. During closed throttle operation, the latter passage will permit the induction of an air/fuel mixture through the idle system in a conventional manner to maintain engine operation when the main fuel metering system is essentially inoperative. Further details of operation and construction of the main and idle fuel systems is not given since they are known, conventional, and are believed to be unnecessary for an understanding of the invention.

Suffice it to say, that during idle speed operation with closed throttle positions, a very lean air/fuel mixture will be inducted into the engine through the idle system on the primary side as well as the secondary side, which is essentially a duplicate of the primary side insofar as the fuel system is concerned. As soon as the throttle valve 16 is open, the increased signal on the boost venturi will phase in the main fuel metering system in a known manner to provide progressively greater quantities of air/fuel mixture to the engine and in the proper proportion.

When the engine speed is such that flow through the primary passage 12 is at a capacity, then actuation of the secondary throttle valve 18 is desirable to increase air and fuel supply to meet engine requirements. In this case, the secondary throttle valve 18 is opened during engine accelerative operations by a vacuum servo 40 whose operation is triggered by a vacuum signal from the primary induction passage venturi section. More specifically, the secondary throttle valve 18 is fixed on a shaft 42 on which is secured a lever 44. Pivotally connected to lever 44 is a servo plunger or rod 46 projecting movably through the housing 48 of the vacuum servo 40. The housing is hollow and divided interiorly by a flexible annular diaphragm 50 that separates the internal chamber into an air chamber 52 and a vacuum chamber 54. The air chamber is connected to air at essentially atmospheric pressure through the opening 56 through which the plunger or rod 46 moves. The vacuum chamber is connected by a passage 58 in the central dividing portion of the carburetor body 60 past a ball check valve 62 to a passage 64 connected directly to the primary induction passage venturi throat 66. An orifice or flow restriction 68 is used to meter the signal and prevent primary passage flow fluctuations from oscillating the servo 40. The ball check valve 62 prevents loss of vacuum signal by seating in the ends of the passage 58 on reversal of pressure conditions.

The servo diaphragm 50 is fixed to the plunger 46 by a pair of retainer members 70, the upper retainer also forming a seat for a compression spring 72. The latter urges or biases the throttle valve 18 to a position closing the secondary induction passage.

When flow conditions through the primary passage 12 are high enough, the signal in passage 64 is sufficient to overcome the force of spring 72 and rotate the throttle valve 18 open in proportion to the signal to subject the secondary passage boost venturi (not shown) to the signal in the intake manifold and thereby induct further fuel/air mixture into the engine to meet engine requirements.

During engine deceleration operation, the throttle valves 16 and 18 normally are closed. This, therefore, requires idling systems for the primary and secondary passages, which results in a very lean mixture under these very high vacuum conditions. It would be natural, therefore, to assume that more complete burning would be provided by supplying a slightly richer mixture at this time by opening the primary throttle valve 16. However, there are conditions of operation during deceleration, such as, for example, when only gradual deceleration occurs with a partially opened throttle valve. In this case, therefore, with the throttle valve already partially opened, further opening of the primary throttle valve to increase mixture flow would have little affect.

Therefore, in this instance, apparatus is provided to crack open the secondary throttle valve 18 a predetermined amount to insure that an additional fuel/air mixtue will be supplied to the engine regardless of the quantity of flow being supplied through the primary induction passage and regardless of the position of the primary throttle valve 16. As best seen in FIG. 1, secondary throttle valve 18 is adapted to be controlled during deceleration operation by a second vacuum servo 80. The servo per se is of a conventional construction having an annular flexible diaphragm 82 dividing a hollow shell 84 into an air chamber 86 and a vacuum chamber 88. The vacuum chamber is connected by a tube 90 to any suitable point in the intake manifold or at a point below the throttle valve in the carburetor so as to be sensitive to the high manifold vacuum prevelant during engine deceleration operating conditions. The air chamber 86 is connected by a suitable vent, not shown, to atmosphere or ambient pressure surrounding conditions. The diaphragm 82 is fixed to a plunger or rod 92 having an elongated slot 94 in which slides a pin 96. The latter is formed as a part of a right angle bend on a lever 98 pivotally secured to an ear 100 a bell-crank-type lever 102 fixed on the secondary throttle shaft 42. It will be seen that the plunger 46 of the servo 40 is also pivotally connected at 104 to lever 102.

The supply of intake manifold vacuum to servo 80 is adapted to be controlled by both an engine speed sensor and an intake manifold vacuum sensor so that the secondary throttle valve is not cracked open during deceleration operating conditions unless selective conditions are occurring. In other words, the servo 80 is not permitted to be operated unless the engine speed and manifold vacuum are above a certain level indicating a need for operation of the servo.

More particularly, FIG. 3 illustrates schematically an electrical control system for controlling the operation of servo 80 and therefore cracking open of the secondary throttle valve. The control system shows the engine 110 having an intake manifold 112 with a tap 114. Manifold vacuum is sensed through a line 116 to a vacuum closed electrical switch 118 and through a line 120 to a solonoid-actuated vacuum control valve 122. The switch 118 is of a known construction and is merely an on/off type switch that is actuated by high intake manifold vacuum prevelant during engine deceleration conditions to close and electrically connect a ground 124 to the terminal 126 of the emitter portion of a power transistor 128. The latter forms part of an electronic module indicated in general at 135, and has a collector portion 132 connected to a terminal 134. Terminal 134 in turn is connected to one side or contact of the solonoid 127 for valve 122. The other contact or side of the solonoid is electrically connected by a line 136 to a battery 138 having a ground 140.

The circuitry for the electronic control unit 135 would include an input frequency sensor from an engine ignition coil, not shown, so that as engine speed increases, so does the frequency of the coil. Since, as stated previously, actuation of secondary throttle valve 18 is not desired during decelerations below 2100 rpm, for example, the electronic module is designed to not render the power transistor 128 conductive until the frequency of the coil indicates the engine speed is at the desired level. Then the solonoid of the vacuum valve can be energized if switch 118 is closed, and the valve 122 will be opened.

Vacuum valve 122 can be a simple on/off known type of flow control valve that is opened upon energization of the solonoid 127 to connect the vacuum in line 120 to the line 90 leading to servo 80. Since the transistor circuit is connected in series relationship with the solonoid of valve 122, the vacuum valve 122 will be opened only when the intake manifold vacuum reaches or passes 19'' Hg. and the engine speed is above 2100 rpm. When these two conditions occur concurrently, then the circuit is completed to the solonoid 127. Servo 80 will then be actuated to crack open the secondary throttle valve 18 and thereby provide an additional supply of fuel/air mixture to the engine at this time to provide more complete burning of the engine mixture and less emission of undesirable elements into the atmosphere.

While the invention has been shown and described in its preferred embodiment, it will be clear to those skilled in the arts to which it pertains that many changes and modifications may be made thereto without departing from the scope of the invention.

I claim:

1. A carburetor having separate primary and secondary air/fuel mixture induction passages each connected at one end to air at essentially atmospheric pressure and adapted to be connected at its opposite end to an engine intake manifold to be subject to the change in depression therein from a minimum level to a maximum vacuum force level occurring during engine deceleration conditions, a separate throttle valve mounted for a rotatable movement across each of the passages between an open and closed position to control flow through the passage, first control means operably connected to the throttle valves to open the valves, and second control means operably connected to the secondary induction pssage throttle valve and operable independently of the first control means during engine deceleration operating conditions to crack open the secondary passage throttle valve to provide air/fuel mixture flow through the secondary induction passage.

2. A carburetor as in claim 1, the second control means including a vacuum servo having a plunger connected to the secondary passage throttle valve, a vacuum line connected to engine intake manifold and to the servo, the servo including a spring urging the plunger to a secondary passage throttle valve closed position.

3. A carburetor as in claim 2, including engine speed responsive means operably connected to the vacuum line for effecting normal blocking of the communication of vacuum to the line and movable to a position effecting opening of the line in response to the attainment of a predetermined engine speed.

4. A carburetor as in claim 2, the second control means including valve means in the line normally blocking vacuum flow therethrough, and engine speed responsive means and manifold vacuum responsive means operably connected in series to the valve means for operation of the valve means upon the concurrent attainment of a predetermined engine speed and manifold vacuum level.

5. A carburetor as in claim 4, the valve means comprising a normally closed electrically opened vacuum flow valve, the vacuum responsive means comprising a normally open switch closed by manifold vacuum connected thereto and acting thereagainst, the switch being electrically connected to the flow valve, the speed responsive means also being electrically connected to the vacuum flow valve.

6. A carburetor as in claim 3, the vacuum flow valve being solonoid actuated to a flow position, the electrical connections including a source of electrical energy varying in proportion to the engine speed and connected to one side of the solonoid, the vacuum switch being located electrically between a ground connection and the other side of the solonoid whereby a circuit is completed to the solonoid upon the attainment of predetermined engine speed and manifold vacuum.

7. A carburetor as in claim 1, the first control means including force means connected to the secondary passage throttle valve and operable in response to the attainment of a predetermined engine accelerative condition of operation in the primary passage to open the secondary passage throttle valves, and lost motion means between the force means and the operable connection of the second means to the secondary passage throttle valve to permit movement of the secondary passage throttle valve independently by each of the first force means and second means.

8. A carburetor as in claim 1, the first control means including another vacuum servo having a plunger operably connected to the secondary passage throttle valve, a spring urging the plunger to a secondary passage throttle valve closed position, another vacuum line connecting the servo plunger and the primary induction passage above the primary passage throttle valve to be subject to air flow changes therein, whereby the other servo plunger is actuated above a predetermined primary passage air flow to open the secondary passage throttle valve for accelerative engine operation, and lost motion means between the operable connections of the first and other servos to the secondary passage throttle valve to permit independent movement of the secondary passage throttle valve by each of the respective servos.

9. A carburetor as in claim 8, the lost motion means including a pin and slot connection between the second servo plunger and secondary passage throttle valve.

* * * * *